US005492469A

United States Patent [19]

Oda et al.

[11] Patent Number: 5,492,469

[45] Date of Patent: Feb. 20, 1996

[54] GASEOUS FUEL BURNER AND DUAL PROBE SPARK ELECTRODE THEREFOR

[75] Inventors: Kenneth J. Oda, Elk Grove Village; Lawrence T. Budnick, St. Charles, both of Ill.

[73] Assignee: Eaton Corporation, Cleveland, Ohio

[21] Appl. No.: 434,741

[22] Filed: May 4, 1995

[51] Int. Cl.[6] ..... F23Q 3/00

[52] U.S. Cl. ..... 431/266; 431/263

[58] Field of Search ..... 431/263, 264, 431/266

[56] References Cited

U.S. PATENT DOCUMENTS 5,112,218 5/1992 Sigler ..... 431/266
5,149,262 9/1992 Riehl ..... 431/266
5,160,256 11/1992 Riehl ..... 431/266
5,328,358 7/1994 Riehl ..... 431/266
5,364,264 11/1994 Kwiatek ..... 431/266

*Primary Examiner*—Carroll B. Dority
*Attorney, Agent, or Firm*—Roger A. Johnston

[57] ABSTRACT

A gaseous fuel burner having an annular base with a tubular inlet and enlarged diameter flange remote from the inlet deferring a cavity communicating with the inlet. A cap is registered against the flange rim to close the cavity and define a plurality of peripheral flame-generating ports. A pocket is formed in the periphery of the flange with an aperture formed in the pocket. A tubular ceramic igniter body with an enlarged flanged end is registered in the aperture. An elongated strip electrode is received through the igniter body in guideways; and, one end of the electrode is bifurcated and extends beyond the flange and is found at generally right angles to extend in spaced parallel arrangement with the face of the ignitor body flange for sparks discharge to the burner cap.

20 Claims, 3 Drawing Sheets

GASEOUS FUEL BURNER AND DUAL PROBE SPARK ELECTRODE THEREFOR

BACKGROUND OF THE INVENTION

The present invention relates to fuel gas burners for cooking appliances and particularly burners of the type employed in cooktop or rangetop applications where a receptacle or cooking vessel is seated on the surface of the burner for heating of the foodstuffs or liquid within the vessel. Cooktop burners are typically ignited by the user opening a rotary valve in the supply line to provide a flow of the fuel gas to the burner whereupon a set of switch contacts are simultaneously closed for electrically energizing an igniter having an electrode disposed to provide a spark in the stream of fuel air mixture emanating from a port in the burner. If an alternating current voltage is employed for the spark ignitor, upon ignition of the fuel air mixture and the presence of flame about the ignitor electrode, the phenomenon of flame rectification occurs; and, the change in the current may be electrically detected as an indication or proof of the presence of flame. This technique has been widely employed for combining the function of the ignitor with that of a flame sensor and providing electrical circuitry which could respond to the change in alternating current to turn off the sparking voltage to the ignitor. It is also known to provide circuitry which, upon the loss of flame, electrically detects the change of a current in the electrode and reenergizes the ignitor spark voltage automatically. However, if transient air currents extinguish the flame about an annular plural port burner on only a portion of the periphery, the flame sensor may not be able to determine whether the flame has been totally extinguished and an annoying reenergization of the ignitor occurs. The condition may also occur where variations in the line pressure of the fuel gas cause major fluctuations in the flame.

Thus, it has long been desired to provide a way or means of preventing flame loss in the region of the flame sensing ignitor when flame is being sustained in other regions of the burner and to generally stabilize the flow from the flame generating ports in the burner. It has further been desired to improve the effectiveness of a spark ignitor for a cooktop burner and to provide such functions in a burner which is sufficiently low in manufacturing cost to remain competitive in the high-volume domestic appliance marketplace.

SUMMARY OF THE INVENTION

It is an object of the present invention to provide a fuel gas burner for a cooktop having a spark ignitor disposed in a pocket formed adjacent certain flame-generating ports and to provide flame stabilization passages intermediate the flame-generating ports.

It is a further object of the present invention to provide a spark ignitor assembly for a cooktop fuel gas burner with the ignitor assembly having a tubular refractory body with an electrode disposed therethrough with one end of the electrode bifurcated for providing dual sparking surfaces.

It is a further object of the present invention to provide an ignitor assembly for a cooktop fuel gas burner, the ignitor having a tubular refractory body having a conductive electrode received therethrough with an air passage therethrough along the electrode.

The cooktop burner of the present invention has a tubular inlet portion with an enlarged diameter portion formed at the remote end thereof and defining a fuel air mixture cavity which is closed by a burner cap along a parting line. An ignition pocket is formed in the periphery with a cut-out or aperture formed in the pocket with an ignitor received in the aperture. The ignitor has a tubular body of refractory material with an enlarged diameter flange formed at one end which is registered against the surface of the cut-out in the pocket. An elongated electrode is received through the tubular ignitor body with one end extending beyond the enlarged flange and bifurcated for providing dual sparking surfaces. In the preferred form the bifurcated end of the electrode is disposed at right angles to the direction of elongation.

DETAILED DESCRIPTION

Figure 1:
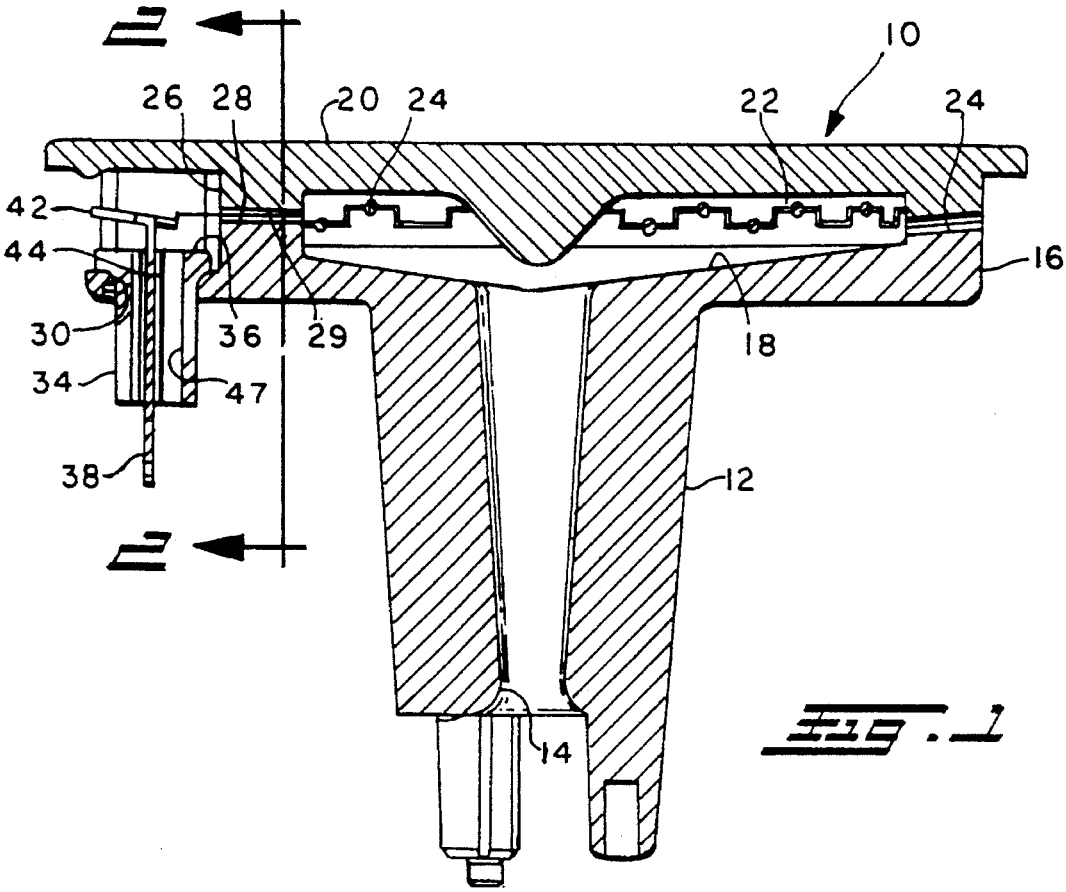
FIG. 1 is a cross-section of the cooktop burner of the present invention in the assembled condition.
Figure 2:
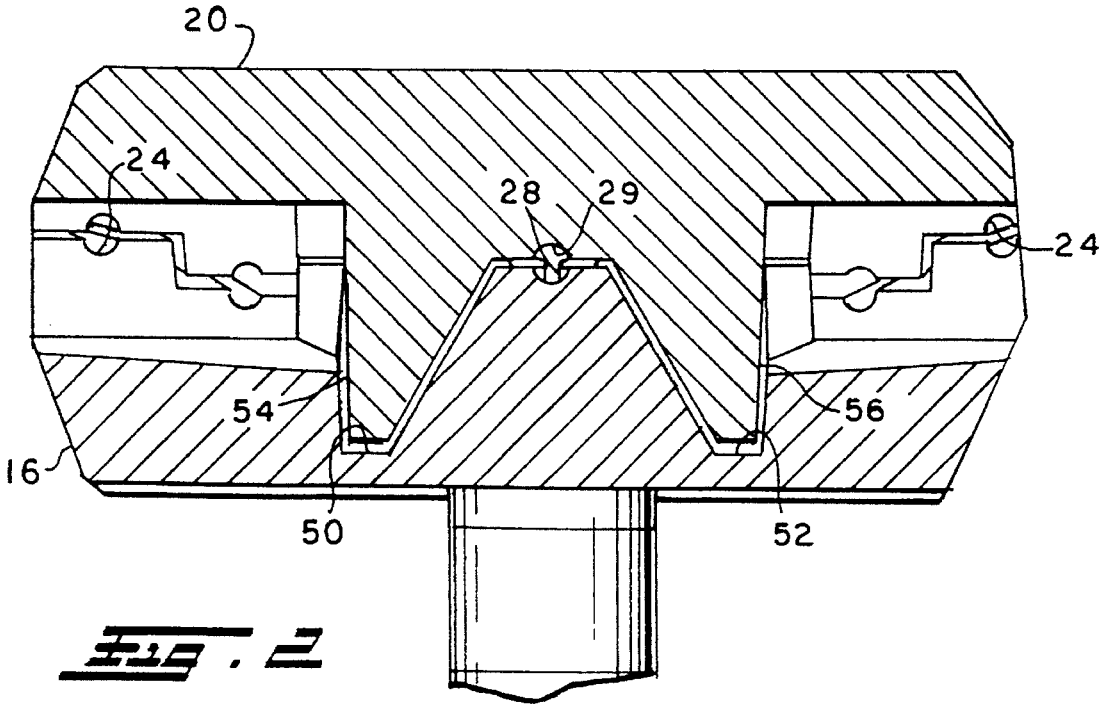
FIG. 2 is an enlarged section view taken along section indicating lines 2—2 of FIG. 1.
Figure 3:
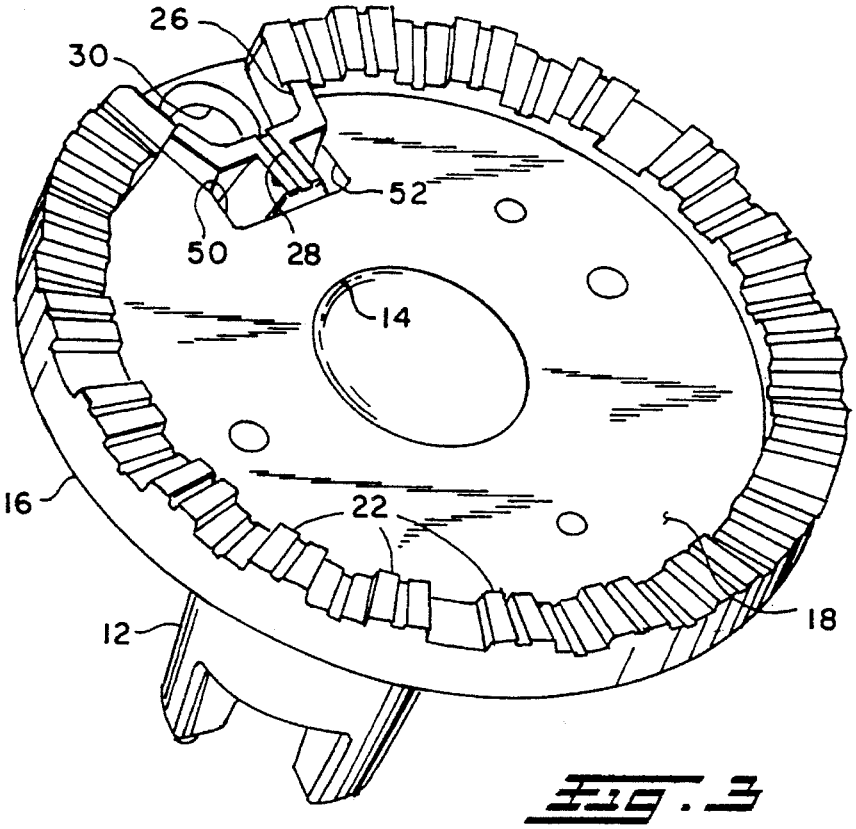
FIG. 3 is an axonometric view of the burner base of the embodiment of FIG. 1.

Referring to FIGS. 1–3, the assembly of the present invention is indicated generally at 10 and includes a base or body 12 which has a reduced diameter inlet portion defining an inlet 14 and an enlarged diameter flange portion 16 formed at the end thereof remote from the inlet and defining a fuel air mixture cavity 18 which is closed by a burner cap 20 registered thereagainst. The parting line between the cap 20 and the base 12 is formed with interdigitated portions which are preferably castellated as shown in the drawings but which may also be formed as sinusoidal or in a triangular toothed pattern.

The alternate interdigitations or teeth denoted by reference numeral 22 serve as registration surfaces for the cap 20 against the annular portion 16 of the base 12 and define therebetween a plurality of primary flame-generating ports 24 which communicate with the plenum cavity 18.

Figure 4:
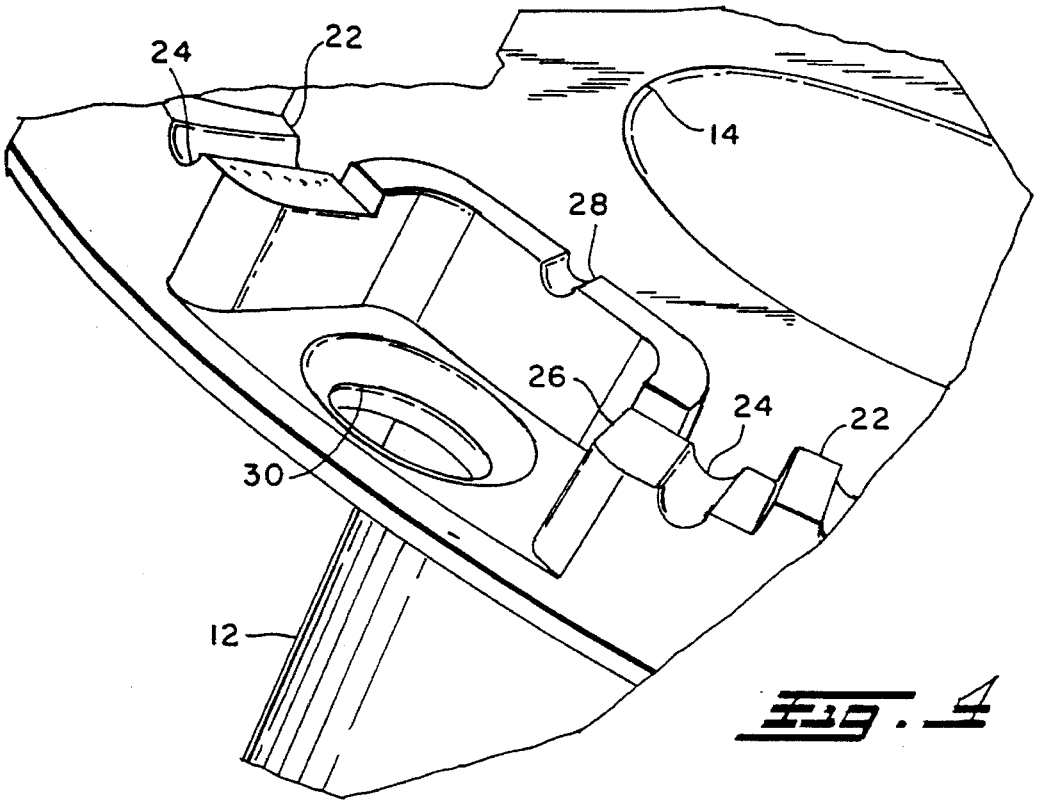
FIG. 4 is an enlarged view of a portion of FIG. 3 viewed from behind.

Referring to FIGS. 3 and 4, the base 12 is shown with the cap 20 removed and has an ignition pocket or recess 26 formed in the periphery thereof, which pocket has formed therein an independent ignition port which communicates the cavity 18 with the pocket 26. In the presently preferred practice the base 12 and cap 20 are formed of cast aluminum; and, to facilitate manufacturing, the ignition port is formed partially as a groove 29 in the cap and partially as a matching groove 28 in the base.

Pocket 26 has an aperture 30 formed through the flange in the bottom of the pocket as shown in FIGS. 3 and 4.

Figure 5:
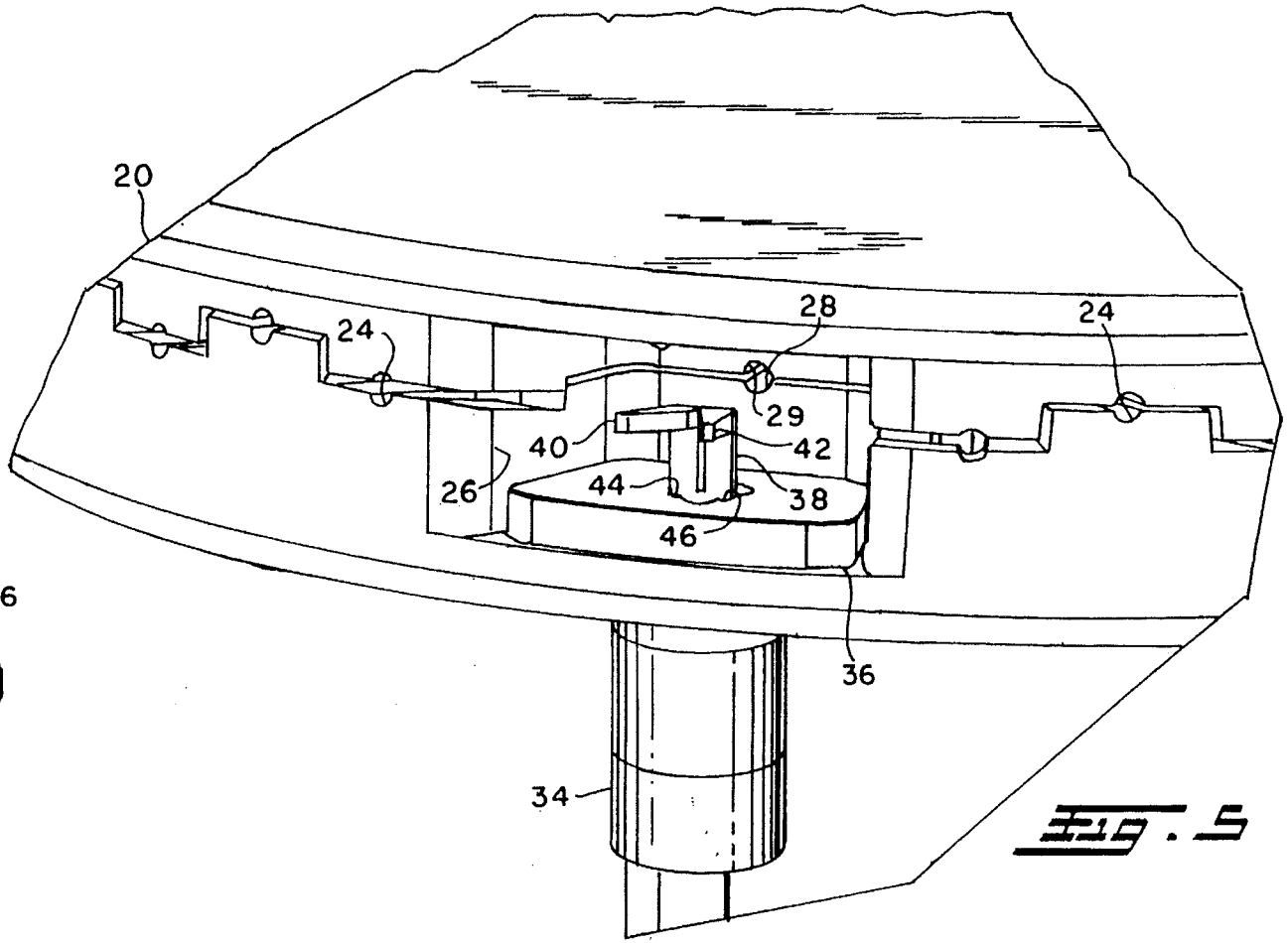
FIG. 5 is an enlarged portion of a left end view of the embodiment of FIG. 1.
Figure 6:
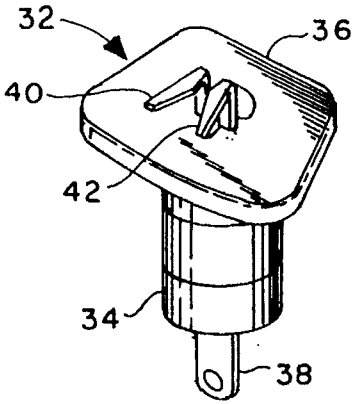
FIG. 6 is an axonometric view of the ignitor assembly of the embodiment of FIG. 1; and, FIG. 7 is a view similar to FIG. 6, of another embodiment of the ignitor.

Referring to FIGS. 5 and 6, an ignitor assembly indicated generally at 32 has a tubular body 34 formed of refractory or ceramic material and has an enlarged radially outwardly extending flange 36 formed at one end thereof. An elongated preferably flat strip conductive electrode 38 is received therethrough and extends outwardly from the lower end of the tubular body 34 for external electrical connection thereto. The opposite end of the electrode 38 is bifurcated and extends outwardly through the flanged end of the ignitor body. The bifurcated portions indicated by reference numerals 40,42 are formed externally of the flange 36 at generally right angles to the direction of elongation of the strip 38. The bifurcated portions 40,42 preferably extend in generally spaced parallel relationship to the end face of flange 36.

Referring to FIG. 6, the inner periphery of the body 34 of the ignitor has a pair of oppositely disposed space parallel guide grooves or ways 44,46 formed therein. The electrode "conductor" strip is held in place with a ceramic adhesive. The guide grooves 44,46 are configured to provide an air passage 47 about the electrode 38 through tubular body 34.

Figure 7:
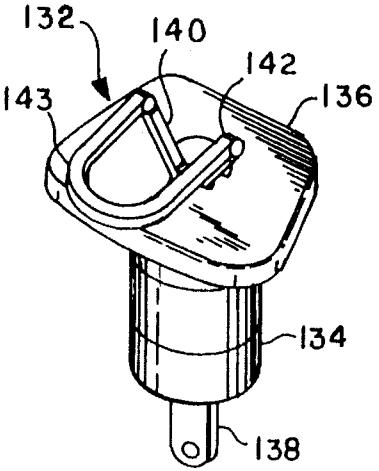

Referring to FIG. 7, an alternative embodiment of the ignitor assembly is illustrated generally at 132 and has a tubular body 134 with an enlarged flange 136 at one end thereof with a generally flat conductive electrode strip 138 received therethrough with one end thereof extending outwardly from flange 136 and bifurcated as indicated by reference numerals 140, 142. The bifurcated portions 140, 142 are interconnected by a generally U-shaped bar portion 143 which extends in generally spaced parallel arrangement with the end face of flange 136. The arrangement of FIG. 7 thus provides increased surface area on the electrode parallel to the undersurface of the burner cap 20 for spark discharge thereto from the electrode. The bifurcated end of the electrode 38,138 provides for additional separated areas of spark discharge on the undersurface of cap 20 to thereby improve the reliability of the ignitor and increase the amount of spark area to ignite the fuel mixture emanating from the ignition port 28. The spark electrode design of the present invention also provides increased area of electrode to function as a flame-sensing probe after ignition, a function which is known in the art. The tubular form of the ignitor body 34 provides for secondary air to be drawn through the ignitor body passage 47 to aid in combustion of the flame in the pocket 26 from the ignition port formed by grooves 28,29.

Referring FIGS. 2, 3 and 5, recesses 50,52 are provided in the burner base on the radially inner surface of the wall of pocket 26 and disposed on opposite sides of the ignitor groove 28; and, corresponding projections 54,56 extend downwardly from the undersurface of cap 20 and interdigitate with the recesses 50,52 to orient the ignitor groove 28 in the undersurface of the cap with the groove 28 formed in the base to form the ignitor port. The material between recesses 50,52 in the ignitor base serve to provide extra material radially inwardly of the burner pocket wall to extend the length of the groove 28; and, the corresponding port formed by closure of the cap thereover provides attenuation of pressure fluctuations through the ignitor port to thereby stabilize the ignitor flame.

The present invention thus provides an improved gas burner having an annular base or body having a tubular inlet portion with an enlarged annular flanged end with a pocket formed in the periphery thereof with an ignitor received through an aperture in the pocket for spark discharge to the undersurface of a burner cap. The burner body flange defines a mixing cavity beneath the burner cap communicating with the inlet. The ignitor employs a tubular ceramic body with an enlarged diameter end flange having an elongated strip conductive electrode received in a pair of oppositely disposed parallel guideways formed within the ignitor body. One end of the electrode extends from an end of the ignitor body for electrical attachment thereto; whereas, the opposite end of the electrode extends through the ignitor body beyond the enlarged flange and is bifurcated and formed at generally right angles to the ignitor body to extend in spaced parallel relationship with the end face of the flange. The ignitor body is received in an aperture formed in the ignitor pocket. The ignitor construction provides an electrode having increased area for spark discharge and flame sensing. In one embodiment the bifurcated ends are open; and, in another embodiment are connected by a generally U-shaped member.

Although the present invention has been described hereinabove with respect to the illustrated embodiments, it will be understood that the invention is capable of modification and variation and is limited only by the following claims.

We claim:

1. A fuel gas burner assembly comprising:

(a) an annular burner base having an inlet portion and an enlarged portion with a plurality grooves disposed about the periphery and a burner cap closing said base and having a plurality of grooves forming primary flame generating ports with the groves in said base;

(b) said base having a pocket formed in the periphery and one of said primary flame generating ports communicating with said pocket and an ignitor cut-out formed in said pocket;

(c) a tubular insulator received in said cut-out, said insulator formed of ceramic material, said insulator defining an air passage therethrough; and, (d) an electrode member disposed in said insulator and having a bifurcated end portion extending outwardly from one end of said insulator, wherein said insulator is received in said ignitor cut-out and said electrode bifurcated end is disposed spaced adjacent said cap for spark discharge therebetween.

2. The assembly defined in claim 1, wherein said insulator has an enlarged diameter flange formed at said one end, said flange registered against said base about said cut-out.

3. The assembly defined in claim 1, wherein said electrode extends outwardly of said insulator from an end remote from said one end and is adapted for electrical connection thereto.

4. The assembly defined in claim 1, wherein said electrode is formed of an elongated strip having said bifurcated end formed generally at right angles to the direction of elongation of said strip.

5. The assembly defined in claim 1, wherein said insulator has a radially outwardly extending flange formed at one end thereof; and, said bifurcated end of said electrode extends in spaced generally parallel relationship to said flange.

6. The assembly defined in claim 1, wherein said insulator has a radially outwardly extending flange formed integrally at said one end.

7. The assembly defined in claim 1, wherein said pocket has a pair of oppositely disposed walls in generally diverging arrangement.

8. The assembly defined in claim 1 including means forming a transfer passage between certain adjacent ones of said primary ports.

9. The assembly defined in claim 1, wherein said base inlet portion includes means defining an aspirator.

10. The assembly defined in claim 1, wherein said cut-out comprises an aperture formed in a radially extending portion of said enlarged portion.

11. The assembly defined in claim 1, wherein said electrode is disposed in said air passage.

12. A method of making a gaseous fuel burner assembly comprising:

(a) forming a burner base having a tubular portion defining an inlet and an enlarged annular portion forming a cavity communicating with said inlet;

(b) disposing a cap over said enlarged portion and forming a plurality of grooves in said base and cap to provide a plurality of flame generating ports thereabout;

(c) forming a pocket in said enlarged portion and forming an aperture in said pocket adjacent one of said ports;

(d) forming a tubular insulator and disposing same in said aperture; and, (e) bifurcating an end of a strip of conductive material and inserting said strip in said insulator and spacing said bifurcated end for sparking discharge to said cap.

13. The method defined in claim 12, wherein said step of disposing an insulator includes forming a radially outwardly extending flange on an end of said insulator and registering said flange against said base about said aperture.

14. The method defined in claim 12, wherein said step of bifurcating includes forming the bifurcated end at right angles to the strip.

15. A fuel gas burner assembly comprising:

(a) a base having a tubular inlet portion with a radially outwardly extending flange formed on one end thereof said flange having a ring formed about the periphery thereof;

(b) a cap registered against said ring and cooperating with said ring to define a plurality of primary flame generating ports;

(c) said ring having a pocket formed in the periphery thereof with an ignition flame generating port therein, said pocket having a cut-out formed in said flange;

(d) a tubular holder formed of refractory material received in said cut-out; and, (e) an elongated electrode strip having a bifurcated end formed generally at right angles to the direction of elongation received in said holder with said bifurcated end disposed for spark discharge to said cap.

16. The burner assembly defined in claim 15, wherein said tubular holder has a pair of guide surfaces disposed on the interior thereof in generally spaced parallel arrangement with said electrode slidably engaged by said guide surfaces.

17. The burner assembly defined in claim 15, wherein said tubular holder has a radially outwardly extending flange formed on the end thereof adjacent said bifurcated end of said electrode.

18. A spark igniter assembly comprising:

(a) a tubular body member formed of refractory material and having a radially outwardly extending flange formed at one end thereof; and, (b) an elongated electrode formed of electrically conductive material disposed within said tubular member and extending outwardly of one end of said member adapted for electrical connection thereto, with the end distal said one end being bifurcated and extending outwardly of said flanged end of said body member, said tubular member defining an air passage therethrough along said electrode.

19. The igniter assembly defined in claim 18, wherein said bifurcated end of said electrode extends at generally right angles to the direction of elongation.

20. The igniter assembly defined in claim 18, wherein said body member includes formed therein a pair of spaced oppositely disposed generally parallel guide surfaces with said electrode slidably received therein.

* * * * *